US006644051B1

(12) United States Patent
Cho et al.

(10) Patent No.: US 6,644,051 B1
(45) Date of Patent: Nov. 11, 2003

(54) CONCENTRATED COOLING APPARATUS OF REFRIGERATOR

(75) Inventors: Seong-Ho Cho, Seoul (KR); In-Seop Lee, Gyeonggi-Do (KR); In-Won Lee, Gyeonggi-Do (KR); Jae-Yong Sung, Seoul (KR); Jay-Ho Choi, Seoul (KR); Kwang-Hyup An, Seoul (KR); Jeong-Ho Lee, Gyeonggi-Do (KR); Young-Sok Nam, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/309,246

(22) Filed: Dec. 4, 2002

(30) Foreign Application Priority Data

Aug. 21, 2002 (KR) ..... 2002/49509

(51) Int. Cl.[7] ..... F25D 17/04; F25D 21/00

(52) U.S. Cl. ..... 62/186; 62/80; 62/408

(58) Field of Search ..... 62/186, 80, 408, 62/152, 154, 275, 441, 451

(56) References Cited

U.S. PATENT DOCUMENTS 4,002,199 A * 1/1977 Jacobs ..... 165/61
5,884,496 A * 3/1999 Kim et al. ..... 62/186
5,899,090 A * 5/1999 Lyu ..... 62/408
5,974,814 A * 11/1999 Park et al. ..... 62/151
6,073,458 A * 6/2000 Kim ..... 62/186
6,401,481 B2 * 6/2002 Hiraoka et al. ..... 62/407

* cited by examiner

*Primary Examiner*—William C. Doerrler
(74) *Attorney, Agent, or Firm*—Greenblum & Bernstein, P.L.C.

(57) ABSTRACT

In a concentrated cooling apparatus of a refrigerator capable of improving cooling efficiency and performance by discharging cold air through only a nozzle at a high-temperature load occurred region among nozzles installed at a side wall of a chilling chamber in order to discharge cold air intensively and preventing a nozzle and an infrared sensor installed at the side wall of the chilling chamber from being icebound, the apparatus includes a housing respectively installed at more than one cold air guide path formed at a side wall of a chilling chamber so as to guide cold air to the side wall of the chilling chamber; a nozzle rotationally supported by the housing and jetting cold air intensively to a high-temperature load occurred region when a high-temperature load occurs inside the chilling chamber; an infrared sensor installed at the front of the nozzle and sensing the high-temperature load occurred region while being rotated with the nozzle; and a nozzle cover installed at the upper surface of the housing, supporting the nozzle so as to expose the upper surface of the nozzle and opening/closing the cold air jet hole by the rotation of the nozzle.

13 Claims, 7 Drawing Sheets

CONCENTRATED COOLING APPARATUS OF REFRIGERATOR

BACKGROUND OF THE INVENTION

1. Field of the Invention

The present invention relates to a refrigerator, and in particular to a concentrated cooling apparatus of a refrigerator which is capable of performing instant cooling operation by discharging cold air intensively onto a high temperature-load occurred region inside a chilling chamber.

2. Description of the Prior Art

FIG. 1 is a perspective-sectional view illustrating the conventional refrigerator, and FIG. 2 is a sectional view illustrating a chilling chamber of the conventional refrigerator.

The conventional refrigerator consists of a main body 104 on which a pair of doors 102 open/closed in two ways installed on the front; a freezing chamber 106 placed on the left of the main body 104 and storing frozen food; a chilling chamber 108 partitioned from the freezing chamber 106 by a separation wall 110, placed on the right side of the main body 104 and storing cold food; and a cold air supply unit, etc. installed at the upper portion of the freezing chamber 106 and supplying air cooled while passing the refrigerating cycle (not shown) to the freezing chamber 106 and the cooling chamber 108.

The cold air supply unit includes a blower 120 installed at the upper rear of the freezing chamber 106 and forcibly ventilating air cooled while passing the refrigerating cycle; a cold air supply path 132 formed at the upper portion of the separation wall 110 in order to make the cold air ventilated from the blower 120 flow into the chilling chamber 108; a cold air discharge duct 134 installed at the upper portion of the chilling chamber 108, communicating with the cold air supply path 132 and discharging the air supplied from the cold air supply path 132 into the chilling chamber 108; and a cold air inflow path 138 formed at the lower portion of the separation wall 110 and making the cold air finishing the cooling operation while circulating the chilling chamber 108 flow into the refrigerating cycle.

Herein, plural cold air discharge holes 136 for discharging cold air into the chilling chamber 108 are formed at the front and lower surfaces of the cold air discharge duct 134.

In the conventional refrigerator, when the refrigerating cycle is operated and the blower 120 is circulated, cold air cooled while passing the refrigerating cycle is discharged into the cold air supply path 132 by the ventilation pressure of the blower 120.

And, the cold air supplied to the cold air supply path 132 flows into the cold air discharge duct 134 and is discharged into the chilling chamber 108 through cold air discharge holes 136 formed on the cold air discharge duct 134. The cold air discharged into the chilling chamber 108 performs the cooling operation of cold food stored in the chilling chamber 108 while circulating inside the chilling chamber 108, and the cold air finishing the cooling operation flows into the cold air inflow path 138 formed at the lower portion of the separation wall 110 and is cooled again while passing the refrigerating cycle.

However, in the conventional refrigerator, a cold air discharge duct is installed at the upper portion of a chilling chamber, cold air is supplied from the upper portion to the lower portion of the chilling chamber through cold air discharge holes formed on the cold air discharge duct, a temperature variation inside the chilling chamber is big according to a distance from the cold air discharge holes. And, because cold air is discharged only from the cold air discharge duct, when a high temperature load occurs due to foodstuff stored inside the chilling chamber, etc., lots of time is required for equalizing a temperature inside the chilling chamber, and freshness of the foodstuff stored in the chilling chamber may be lowered due to delay in cooling.

SUMMARY OF THE INVENTION

In order to solve the above-mentioned problems, it is an object of the present invention to provide a concentrated cooling apparatus of a refrigerator having the same capable of equalizing a temperature variation inside a chilling chamber instantly by installing a concentrated cooling apparatus inside the chilling chamber and discharging cold air intensively on a high-temperature load occurred region inside the chilling chamber and maintaining freshness of foodstuff stored in the chilling chamber by improving a cooling speed on the high-temperature load occurred region.

In addition, it is another object of the present invention to provide a concentrated cooling apparatus of a refrigerator which is capable of improving cooling efficiency and cooling performance by discharging cold air through only a nozzle corresponding to a high-temperature load occurred region among plural nozzles installed at the side wall of a chilling chamber and discharging cold air intensively.

In addition, it is yet another object of the present invention to provide a concentrated cooling apparatus of a refrigerator which is capable of preventing nozzles and an infrared sensor installed at the side wall of a chilling chamber from frost.

In order to achieve the above-mentioned object, a concentrated cooling apparatus of a refrigerator in accordance with the present invention includes a housing respectively installed at more than one cold air guide path formed at a side wall of a chilling chamber so as to guide cold air to the side wall of the chilling chamber; a nozzle rotationally supported by the housing and jetting cold air intensively to a high-temperature load occurred region when a high-temperature load occurs inside the chilling chamber; an infrared sensor installed at the front of the nozzle and sensing the high-temperature load occurred region while being rotated with the nozzle; and a nozzle cover installed at the upper surface of the housing, supporting the nozzle so as to expose the upper surface of the nozzle and opening/closing the cold air jet hole by the rotation of the nozzle.

The nozzle includes the cold air jet hole to jet cold air of the cold air guide path onto the high-temperature load occurred region and a sensor receiving groove to receive the infrared sensor.

The nozzle cover includes an installation portion combined with the upper surface of the housing and having a nozzle insertion hole at the central portion so as to expose the upper surface of the nozzle, and a nozzle opening/closing portion formed at the upper surface of the installation portion so as to cover part of the exposed upper surface of the nozzle and closing the cold air jet hole when the cold air jet hole goes therein by the rotation of the nozzle.

The installation portion is disc-shaped so as to have a nozzle insertion hole at the central portion, and the nozzle opening/closing portion is formed so as to cover about ½ of the upper surface of the nozzle and has a globular shape so as to be tightly contacted to the upper surface of the nozzle.

The installation portion and the nozzle opening/closing portion are fabricated as one body.

A heating means is formed at the internal surface of the nozzle opening/closing portion in order to prevent the contact portions between the nozzle opening/closing portion and the nozzle from being icebound by cold air.

The heating means is a circular type hot-wire generating heat when power is applied.

A concentrated cooling apparatus of a refrigerator in accordance with the present invention includes a housing respectively installed at more than one cold air guide path formed at a side wall of a chilling chamber so as to guide cold air to the side wall of the chilling chamber; a nozzle rotationally supported by the housing and jetting cold air intensively to a high-temperature load occurred region when a high-temperature load occurs inside the chilling chamber; an infrared sensor installed at the front of the nozzle and sensing the high-temperature load occurred region while being rotated with the nozzle; a nozzle cover installed at the upper surface of the housing, supporting the nozzle so as to expose the upper surface of the nozzle and opening/closing the cold air jet hole by the rotation of the nozzle; and a cold air discharge portion for removing frost onto the surface of the infrared sensor by jetting part of cold air flowing in the cold air guide path onto the surface of the infrared sensor.

The nozzle cover includes an installation portion combined with the upper surface of the housing and having a nozzle insertion hole at the central portion so as to expose the upper surface of the nozzle, and a nozzle opening/closing portion formed at the upper surface of the installation portion so as to cover part of the exposed upper surface of the nozzle and closing the cold air jet hole when the cold air jet hole goes therein by the rotation of the nozzle.

The cold air discharge portion includes a cold air discharge groove formed at the internal surface of the nozzle opening/closing portion and jetting cold air into the sensor receiving groove receiving the infrared sensor; and a cold air supply groove formed at the outer wall surface of the housing and connecting the cold air discharge groove with the cold air guide duct.

The cold air discharge groove is formed as a concave band type, and an inlet of the cold air discharge groove is arranged on the front of the sensor receiving unit.

The cold air supply groove is formed at the outer side surface of the housing, the upper portion thereof is tightly contacted to the end of the cold air discharge groove, and the lower portion thereof is connected to the through hole formed at the side of the cold air guide duct.

A heater is installed at the internal surface of the nozzle opening/closing portion in order to prevent the contact portions between the nozzle opening/closing portion and the nozzle from being icebound.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Hereinafter, the preferred embodiment of a refrigerator having a concentrated cooling apparatus in accordance with the present invention will be described.

There can be plural embodiments of a refrigerator having a concentrated cooling apparatus in accordance with the present invention, hereinafter, the preferred embodiment will be described.

Figure 1:
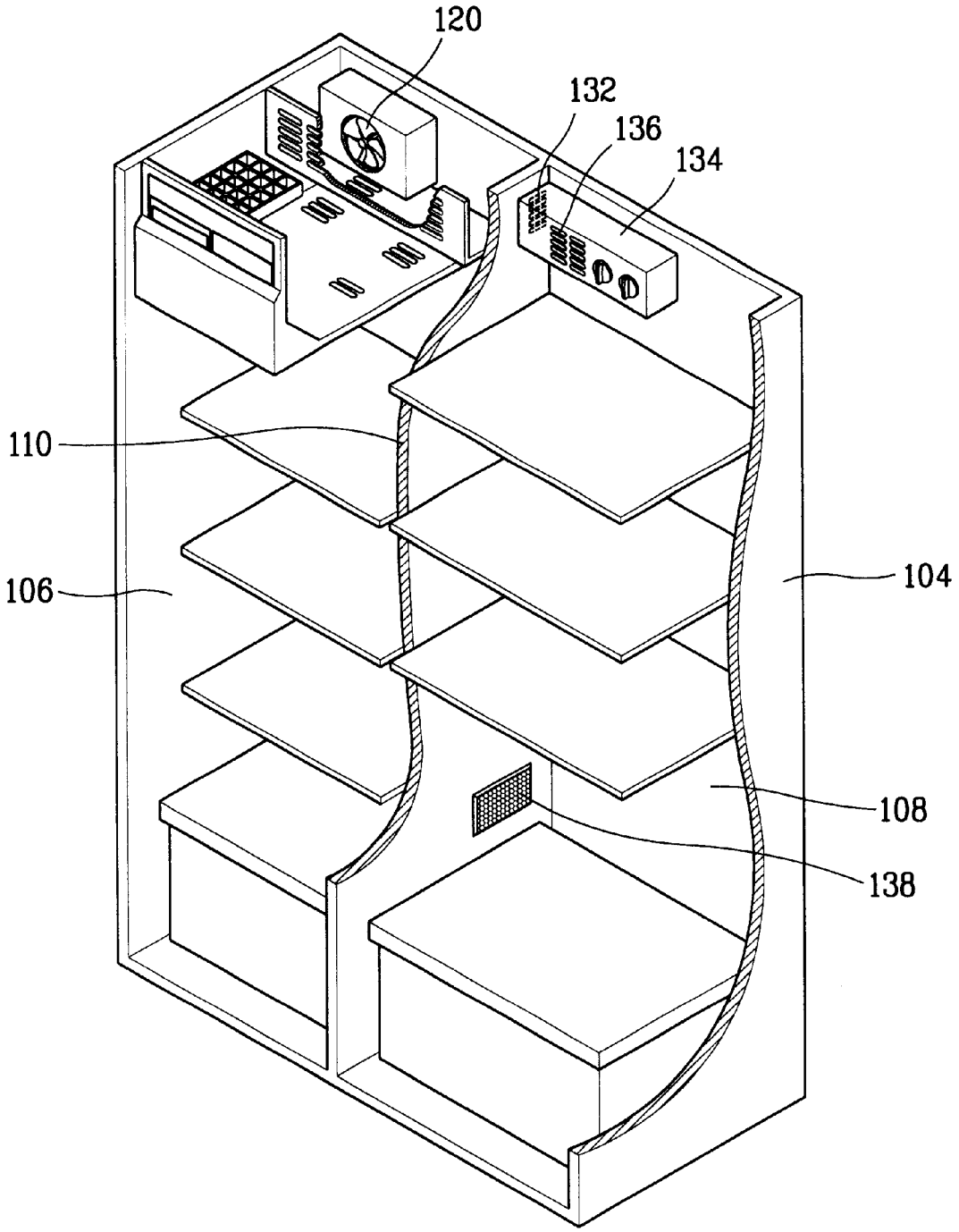
FIG. 1 CONVENTIONAL ART
FIG. 1 is a perspective-sectional view illustrating the conventional refrigerator.
Figure 2:
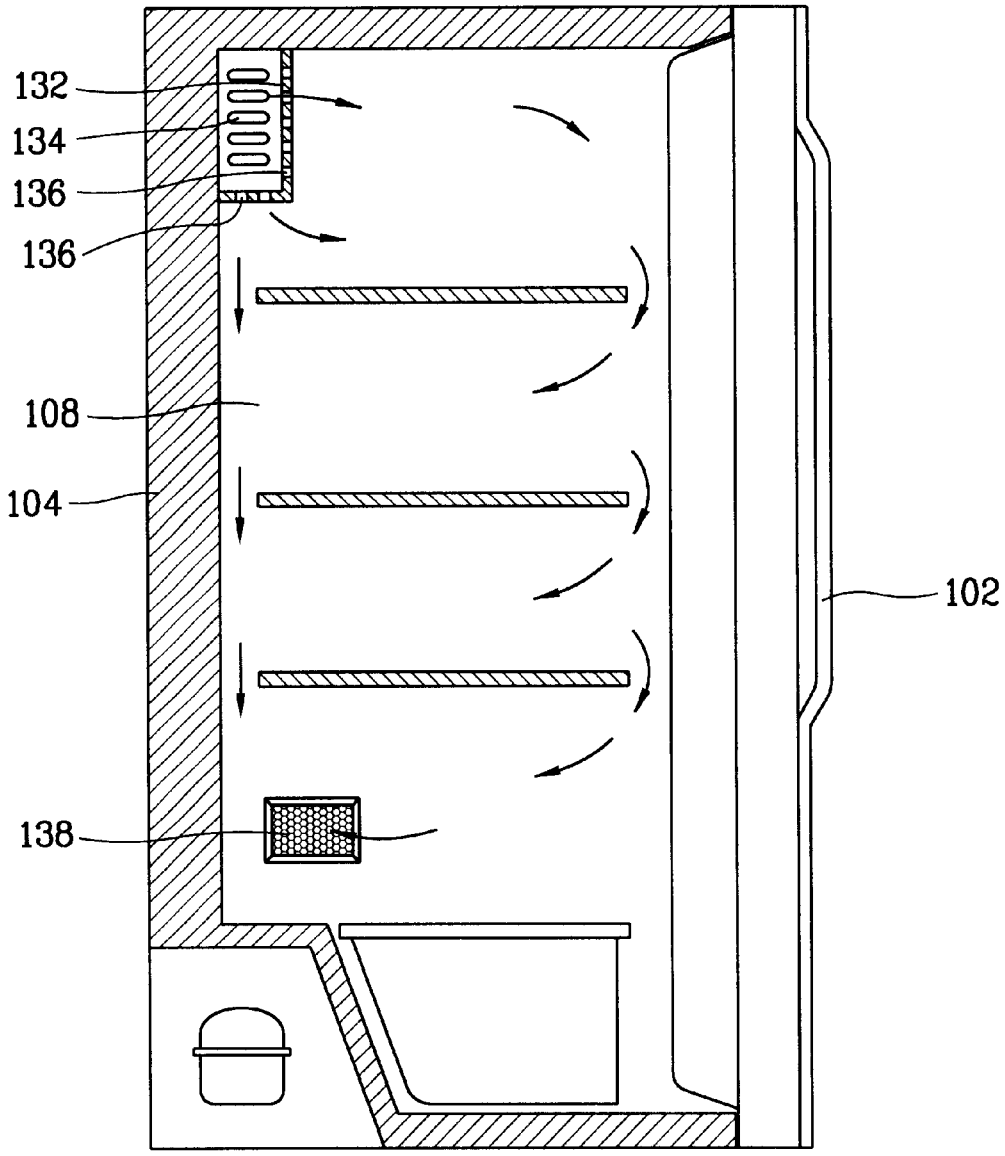
FIG. 2 CONVENTIONAL ART
FIG. 2 is a sectional view illustrating a chilling chamber of the conventional refrigerator.
Figure 3:
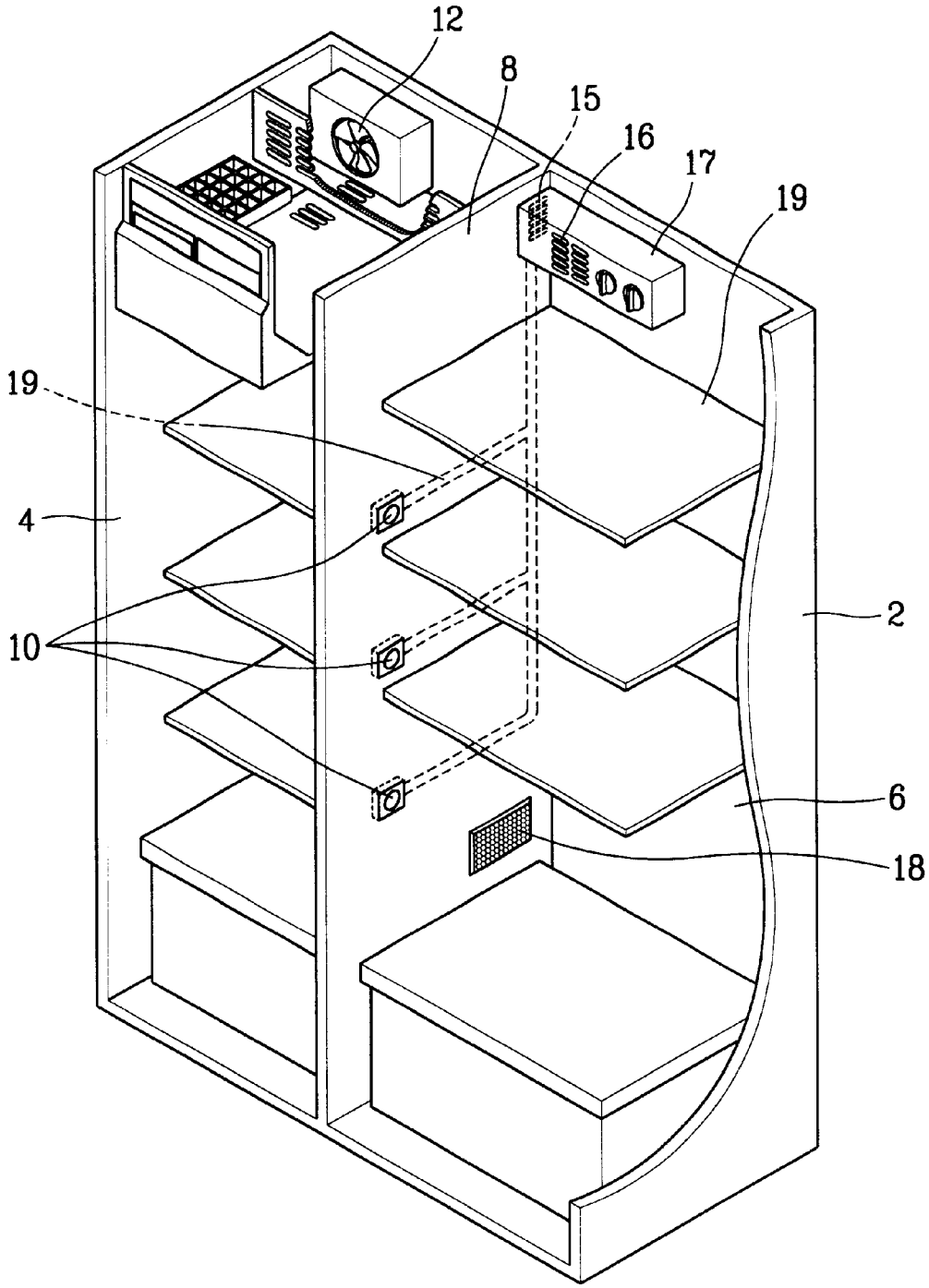
FIG. 3 is a perspective-sectional view illustrating a refrigerator having a concentrated cooling apparatus in accordance with the present invention.
Figure 4:
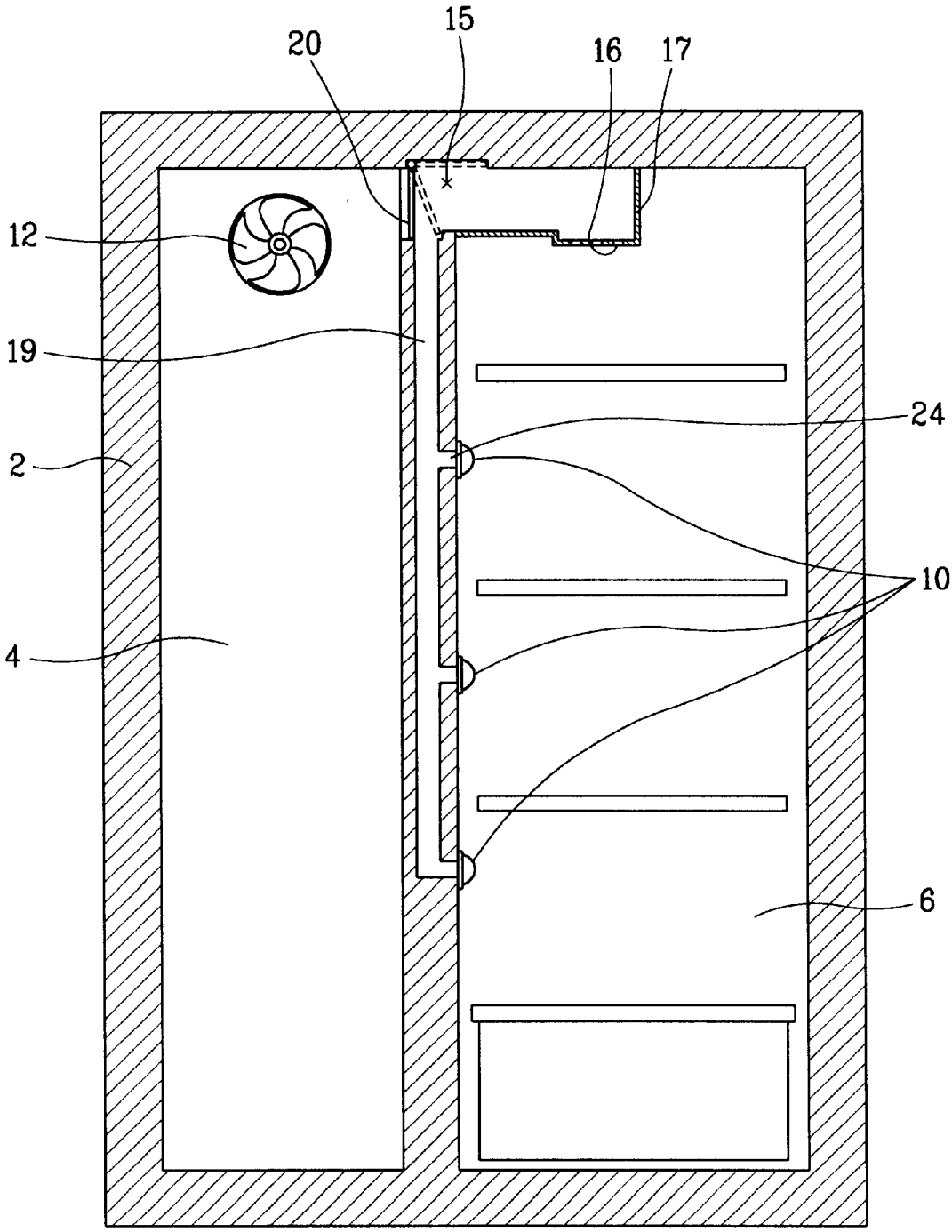
FIG. 4 is a sectional view illustrating the refrigerator having the concentrated cooling apparatus in accordance with the present invention.

FIG. 3 is a perspective-sectional view illustrating a refrigerator having a concentrated cooling apparatus in accordance with the present invention, and FIG. 4 is a sectional view illustrating the refrigerator having the concentrated cooling apparatus in accordance with the present invention.

The refrigerator in accordance with the present invention includes a main body 2 having a certain receiving space in which foodstuff is stored; a blower 12 installed at the upper rear surface of a freezing chamber 4 arranged on the right side of the main body 2 and forcibly circulating air cooled while passing a refrigerant cycle; a cold air supply path 15 formed at the upper portion of a separation wall 8 partitioning the main body 2 into the freezing chamber 4 and a chilling chamber 6 to make cold air sent by the blower 120 flow into the chilling chamber 6; a cold air discharge duct 17 communicating with the cold air supply path 15, installed at the upper portion of the chilling chamber 6 and having a cold air discharge hole 16 for discharging cold air into the chilling chamber 6; and a concentrated cooling apparatus 10 for discharging cold air intensively onto a high-temperature load occurred region inside the chilling chamber 6.

Figure 5:
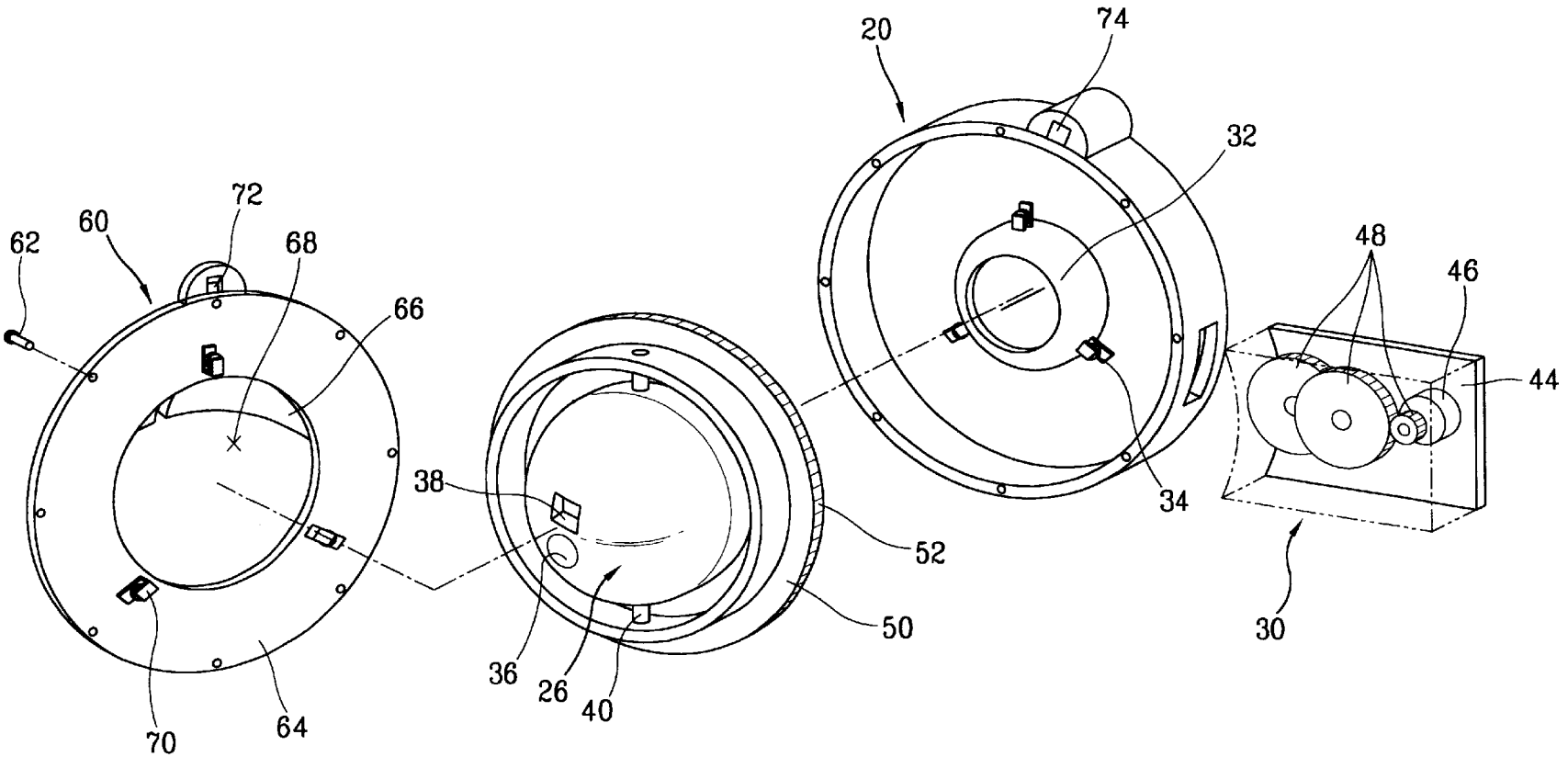
FIG. 5 is an exploded perspective view illustrating the concentrated cooling apparatus in accordance with the present invention.
Figure 6:
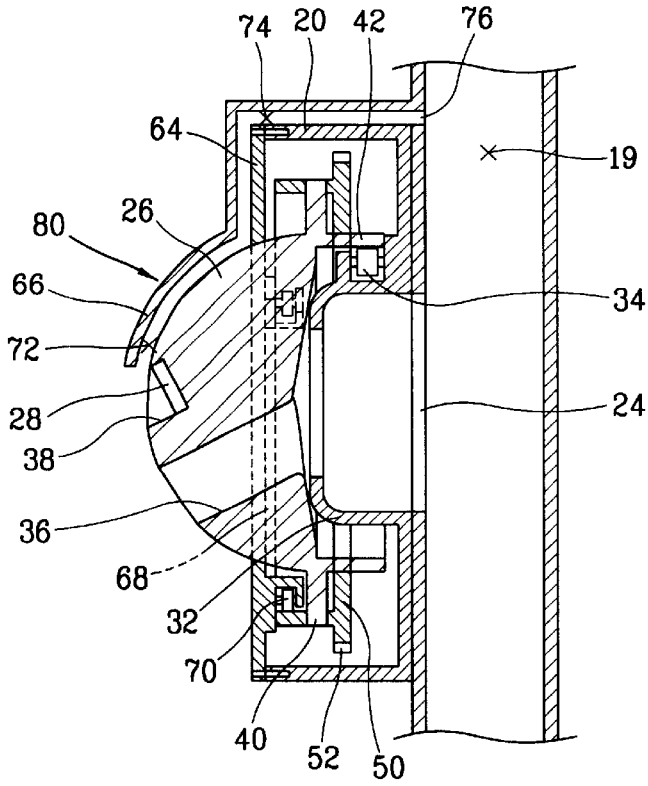
FIG. 6 is a sectional view illustrating the concentrated cooling apparatus in accordance with the present invention.
Figure 7:
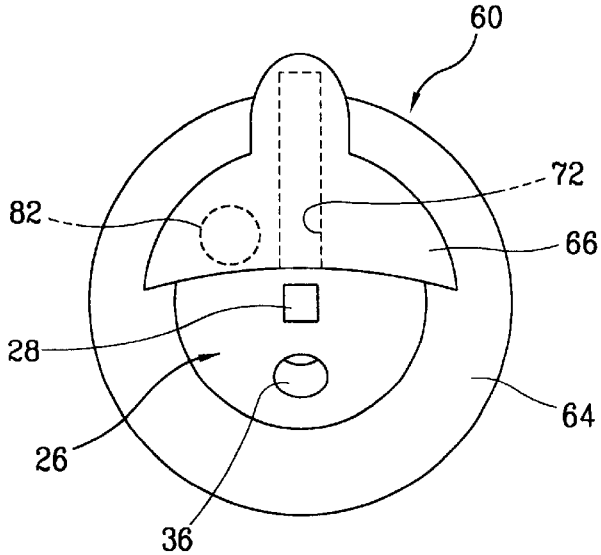
FIG. 7 is a plan view illustrating a nozzle of the concentrated cooling apparatus in accordance with the present invention.

FIG. 5 is an exploded perspective view illustrating the concentrated cooling apparatus in accordance with the present invention, FIG. 6 is a sectional view illustrating the concentrated cooling apparatus in accordance with the present invention, and FIG. 7 is a plan view illustrating a nozzle of the concentrated cooling apparatus in accordance with the present invention.

The concentrated cooling apparatus 10 includes at least one cold air guide path 19 extended from the cold air supply path 15, formed at the side wall of the chilling chamber 6 and guiding cold air to the side wall of the chilling chamber 6; a housing 20 mounted a cold air guide hole 24 formed in a length direction of the cold air guide path 19 for discharging cold air; a nozzle 26 rotationally installed inside the housing 20 and jetting cold air to a high-temperature load occurred region; an infrared sensor 28 installed at the front of the nozzle 26 and sensing the high-temperature load occurred region inside the chilling chamber 6 while being rotated with the nozzle 26; and a nozzle operating unit 30 for rotating the nozzle 26.

The cylinder-shaped housing 20 has an open upper portion, a contact protrusion 32 at which the nozzle 26 is contacted is formed at the center of the internal bottom surface of the housing 20, and plural first support rollers 34 for rotationally supporting the nozzle 26 are installed at the circumference of the contact protrusion 32.

Herein, the contact protrusion 32 has a through hole so as to communicate with the cold air guide hole 24 of the cold air guide path 19, the upper surface of the contact protrusion 32 is curved to facilitate the rotation in contact with the nozzle 26.

The nozzle 26 has a semi-globular shape, and the lower inner circumference of the nozzle 26 is contacted to the contact protrusion 32 of the housing 20. And, a cold air jet hole 36 is formed at the nozzle 26 to jet cold air inside the chilling chamber 10, and a sensor receiving groove 38 in which the infrared sensor 28 is inserted is formed at the upper surface of the nozzle 26. And, a connection rod 40 is formed at the lower portion of the nozzle 26 as one body so as to be connected with a nozzle driving unit 30, and a cylindrical guide portion 42 rotatively supported by the first support roller 34 of the housing 20 is formed at the lower portion of the nozzle 26.

And, the sensor receiving groove 38 has the same tilt angle with that of the nozzle jet hole 36, and the infrared sensor 28 is inserted into the sensor receiving groove 28 and senses a temperature by collecting infrared ray radiated from a heat source on the front of the cold air jet hole 36.

The nozzle driving unit 30 includes a gear box 44 installed at the side of the housing 20; a driving motor 46 disposed in the gear box 44 and generating a driving force; and a nozzle supporting member 50 fixed by the connection rod 40 of the nozzle 26 and connected to the driving motor 46 by the plural gears 48 in order to transmit the driving force of the driving motor 46 to the nozzle 26.

In the nozzle supporting member 50, an open central portion is formed to receive the outer circumference of the guide portion 46 of the nozzle 40, the connection rod 40 is inserted into the side surface, and a gear tooth 52 engaged with the gears 48 is formed at the outer circumference of the nozzle supporting member 50.

A nozzle cover 60 is installed at the open upper surface of the housing 20 to support the nozzle 26 rotationally and open/close the cold air jet hole 36 of the nozzle 26.

The nozzle cover 60 consists of an installation portion 64 combined with the upper surface of the housing 20 by a bolt 62 and a nozzle opening/closing portion 66 formed at the upper surface of the installation portion 64 and opening/closing the nozzle jet hole 36.

The installation portion 64 has a disc shape, in more detail, a nozzle insertion hole 68 is formed at the central portion to receive the nozzle 26, herein, the upper surface of the nozzle 26 is exposed to the outside, and plural second support rollers 70 are formed at the lower circumference of the nozzle insertion hole 66 at regular intervals.

The nozzle opening/closing portion 66 is formed at the upper surface of the installation portion 64 as one body and has a convex surface so as to cover part of the upper surface of the nozzle 26 projected from the upper surface of the installation portion 64. Herein, when the nozzle 26 is rotated and the cold air jet hole 36 goes into the nozzle opening/closing portion 66, an inlet of the cold air jet hole 36 is tightly contacted to the inner surface of the nozzle opening/closing portion 66, and accordingly the cold air jet hole 36 is covered up.

And, a cold air discharge portion 80 is formed at the internal surface of the nozzle opening/closing portion 66 in order to remove moisture condensed onto the surface of the infrared sensor 28 by jetting cold air into the sensor receiving groove 38.

The cold air discharge portion 80 consists of a cold air discharge groove 72 formed at the internal surface of the nozzle opening/closing portion 66 and jetting cold air into the sensor receiving groove 38 receiving the infrared sensor 28;

and a cold air supply groove 74 formed at the outer wall surface of the housing 20, connecting the cold air discharge groove 72 with the cold air guide duct 19 and supplying cold air passing the cold air guide duct 19 to the cold air discharge groove 72.

Herein, the cold air discharge groove 72 is formed as a concave band type and passes cold air when the nozzle opening/closing portion 66 is tightly contacted to the upper surface of the nozzle 26.

In the cold air supply groove 74, the upper portion tightly contacts to the end of the cold air discharge groove 72, and the lower portion is connected to a through hole 76 formed at a certain side of the cold air guide duct 19.

In the cold air discharge portion 80, part of cold air passing the cold air guide duct 19 flows into the cold air supply groove 74 through the through hole 76, cold air flowing into the cold air supply groove 74 passes the cold air discharge groove 72 and is jetted to the sensor receiving groove 38 receiving the infrared sensor 28, moisture condensed onto the surface of the infrared sensor 28 is removed by the jetted cold air, and accordingly reliability of the infrared sensor 28 can be maintained.

And, a heating means is formed at a certain side of the nozzle opening/closing portion 66 in order to prevent the contact portions between the nozzle opening/closing portion 66 and the nozzle 26 from being icebound by the jetted cold air.

As the heating means, it is preferable to install a hot-wire at a certain side of the internal surface of the nozzle opening/closing portion 66 so as to generate heat at a certain temperature when power is applied.

The operation of the concentrated cooling apparatus of the present invention will be described.

Figure 8:
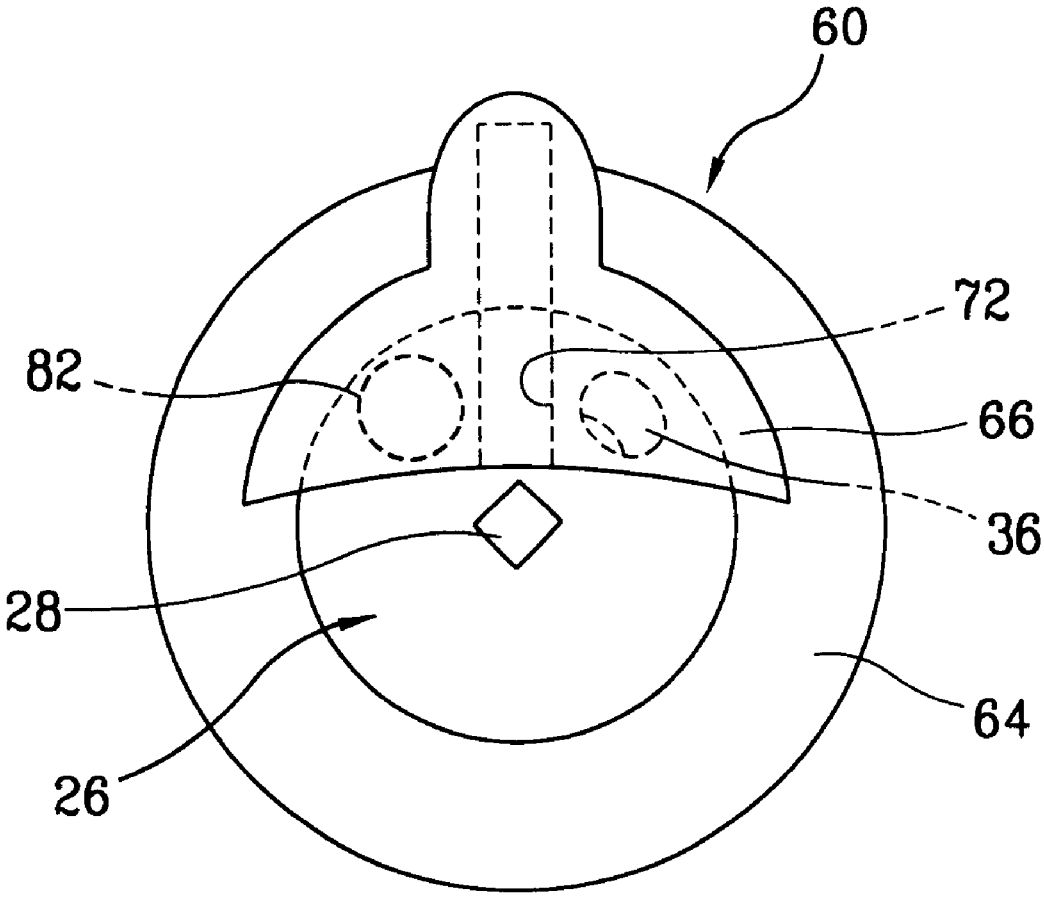
FIG. 8 is a plan view illustrating an operation state of the nozzle of the concentrated cooling apparatus in accordance with the present invention.

FIG. 8 is a plan view illustrating an operation state of the nozzle of the concentrated cooling apparatus in accordance with the present invention.

In the normal operation of the refrigerator, when a high-temperature load occurs at a certain region inside the chilling chamber 6, the infrared sensor 28 senses the high-temperature load occurred region by scanning a temperature inside the chilling chamber 6 and applies it to a control unit (not shown). Then, the control unit rotates the cold air jet hole 36 of the nozzle 26 toward the pertinent region by controlling the driving motor 46 and performs a concentrated cooling onto the high-temperature load occurred region, and accordingly a temperature inside the chilling chamber 6 can be maintained evenly.

Herein, the control unit judges the high-load temperature occurred region by receiving signals applied from the plural infrared sensors 28, performs the concentrated cooling onto the region by opening the nozzle jet hole 36 corresponding to the region and closes the nozzle jet holes of other regions.

In more detail, when the nozzle 26 is rotated by operating the driving motor 46, the nozzle jet hole 36 is inserted into the nozzle opening/closing portion 66 and tightly contacted to the internal surface of the nozzle opening/closing portion 66, and accordingly cold air jet can be cut off.

And, when the hot outside air flows into the refrigerator by opening/closing of the refrigerator door and is cooled, moisture contained in the air is condensed onto the internal surface of the chilling chamber 6. Herein, when the moisture is condensed onto the surface of the infrared sensor 28, sensitivity of the infrared sensor 28 may be lowered, in that case, it is impossible to check a temperature precisely. In order to prevent it, by jetting cold air into the sensor receiving groove 38, the moisture condensed onto the surface of the infrared sensor 28 is removed.

In more detail, part of cold air flowing in the cold guide path 19 flows into the cold air guide groove 74 formed at the side wall of the housing 20 through the through hole 76 formed at the cold air guide path 19, the cold air is jetted from the cold air discharge groove 72 formed at the internal surface of the nozzle opening/closing portion 66 into the sensor receiving groove 38, and accordingly moisture condensed onto the surface of the infrared sensor 28 is removed.

Hereinafter, the effectiveness of the concentrated cooling apparatus of the refrigerator in accordance with the present invention will be described.

By forming plural concentrated cooling units on the side wall of a chilling chamber, when a high-temperature load occurred region is detected by scanning a temperature of all regions of the chilling chamber, cold air is intensively discharged onto the high-temperature occurred region by adjusting a position of a nozzle jet hole by rotating a nozzle, it is possible to perform instant cooling operation and maintain a temperature inside the chilling chamber evenly.

In addition, by performing a concentrated cooling onto the high-temperature occurred region inside the chilling chamber by opening the nozzle jet hole and closing the nozzle jet holes of the nozzles in other regions, it is possible to improve concentrated cooling performance and cooling efficiency.

In addition, by jetting part of cold air flowing in the cold aid guide path into the sensor receiving groove, moisture condensed onto the surface of the infrared sensor inserted into the sensor receiving groove is removed, and accordingly it is possible to maintain sensitivity of the infrared sensor and improve reliability of a temperature check.

What is claimed is:

1. A concentrated cooling apparatus of a refrigerator, comprising:

a housing respectively installed at more than one cold air guide path formed at a side wall of a chilling chamber so as to guide cold air to the side wall of the chilling chamber;

a nozzle rotationally supported by the housing and jetting cold air intensively to a high-temperature load occurred region when a high-temperature load occurs inside the chilling chamber;

an infrared sensor installed at the front of the nozzle and sensing the high-temperature load occurred region while being rotated with the nozzle; and a nozzle cover installed at the upper surface of the housing, supporting the nozzle so as to expose the upper surface of the nozzle and opening/closing the cold air jet hole by the rotation of the nozzle.

2. The apparatus of claim 1, wherein the nozzle includes the cold air jet hole to jet cold air of the cold air guide path onto the high-temperature load occurred region and a sensor receiving groove to receive the infrared sensor.

3. The apparatus of claim 1, wherein the nozzle cover includes an installation portion combined with the upper surface of the housing and having a nozzle insertion hole at the central portion so as to expose the upper surface of the nozzle, and a nozzle opening/closing portion formed at the upper surface of the installation portion so as to cover part of the exposed upper surface of the nozzle and closing the cold air jet hole when the cold air jet hole goes therein by the rotation of the nozzle.

4. The apparatus of claim 3, wherein the installation portion is disc shaped so as to have a nozzle insertion hole at the central portion, and the nozzle opening/closing portion is formed so as to cover about ½ of the upper surface of the nozzle and has a globular shape so as to be tightly contacted to the upper surface of the nozzle.

5. The apparatus of claim 3, wherein the installation portion and the nozzle opening/closing portion are fabricated as one body.

6. The apparatus of claim 3, wherein a heating means is formed at the internal surface of the nozzle opening/closing portion in order to prevent the contact portions between the nozzle opening/closing portion and the nozzle from is being icebound by cold air.

7. The apparatus of claim 6, wherein the heating means is a circular type hot-wire generating heat when power is applied.

8. A concentrated cooling apparatus of a refrigerator, comprising:

a housing respectively installed at more than one cold air guide path formed at a side wall of a chilling chamber so as to guide cold air to the side wall of the chilling chamber;

a nozzle rotationally supported by the housing and jetting cold air intensively to a high-temperature load occurred region when a high-temperature load occurs inside the chilling chamber;

an infrared sensor installed at the front of the nozzle and sensing the high-temperature load occurred region while being rotated with the nozzle;

a nozzle cover installed at the upper surface of the housing, supporting the nozzle so as to expose the upper surface of the nozzle and opening/closing the cold air jet hole by the rotation of the nozzle; and a cold air discharge portion for removing frost onto the surface of the infrared sensor by jetting part of cold air flowing in the cold air guide path onto the surface of the infrared sensor.

9. The apparatus of claim 8, wherein the nozzle cover includes an installation portion combined with the upper surface of the housing and having a nozzle insertion hole at the central portion so as to expose the upper surface of the nozzle, and a nozzle opening/closing portion formed at the upper surface of the installation portion so as to cover part of the exposed upper surface of the nozzle and closing the cold air jet hole when the cold air jet hole goes therein by the rotation of the nozzle.

10. The apparatus of claim 9, wherein the cold air discharge portion includes a cold air discharge groove formed at the internal surface of the nozzle opening/closing portion and jetting cold air into the sensor receiving groove receiving the infrared sensor; and a cold air supply groove formed at the outer wall surface of the housing and connecting the cold air discharge groove with the cold air guide duct.

11. The apparatus of claim 10, wherein the cold air discharge groove is formed as a concave band type, and an inlet of the cold air discharge groove is arranged on the front of the sensor receiving unit.

12. The apparatus of claim 10, wherein the cold air supply groove is formed at the outer side surface of the housing, the upper portion thereof is tightly contacted to the end of the cold air discharge groove, and the lower portion thereof is connected to the through hole formed at the side of the cold air guide duct.

13. The apparatus of claim 9, wherein a heater is installed at the internal surface of the nozzle opening/closing portion in order to prevent the contact portions between the nozzle opening/closing portion and the nozzle from being icebound.

* * * * *

UNITED STATES PATENT AND TRADEMARK OFFICE

CERTIFICATE OF CORRECTION

PATENT NO. : 6,644,051 B1
DATED : November 11, 2003
INVENTOR(S) : S. Cho et al.

It is certified that error appears in the above-identified patent and that said Letters Patent is hereby corrected as shown below:

Column 8,
Line 10, delete "is".

Signed and Sealed this

Sixth Day of July, 2004

JON W. DUDAS
*Acting Director of the United States Patent and Trademark Office*